US006505633B2

(12) United States Patent
Mosely

(10) Patent No.: US 6,505,633 B2
(45) Date of Patent: Jan. 14, 2003

(54) CURLING IRON SHIELD

(76) Inventor: Myra J. Mosely, 8720 Windsor Lake Blvd. #514, Columbia, SC (US) 29233

( * ) Notice: Subject to any disclaimer, the term of this patent is extended or adjusted under 35 U.S.C. 154(b) by 0 days.

(21) Appl. No.: 09/981,451

(22) Filed: Oct. 17, 2001

(65) Prior Publication Data

US 2002/0023285 A1 Feb. 28, 2002

Related U.S. Application Data

(63) Continuation-in-part of application No. 09/717,462, filed on Nov. 20, 2000, now abandoned, which is a continuation-in-part of application No. 09/498,730, filed on Apr. 14, 2000, now abandoned.

(51) Int. Cl.[7] ..... A45D 40/30
(52) U.S. Cl. ..... 132/319; 2/174
(58) Field of Search ..... 132/319, 212, 132/213, 333, 270; 2/455, 456, 174, 468, 209, DIG. 11, 181; D28/10, 9, 99

(56) References Cited

U.S. PATENT DOCUMENTS

| | | | | | |
|---|---|---|---|---|---|
| 2,060,553 | A | * | 11/1936 | Fairchild | 2/174 |
| 2,070,216 | A | * | 2/1937 | Rosenberg | 2/209 |
| 2,149,210 | A | * | 2/1939 | Burleigh | 2/174 |
| 2,159,435 | A | * | 5/1939 | Gribbin | 2/455 |
| 2,296,078 | A | * | 9/1942 | Young | 2/174 |
| 2,600,557 | A | * | 6/1952 | Marriott | 132/212 |
| 2,729,823 | A | * | 1/1956 | Foster | 2/174 |
| 3,235,882 | A | * | 2/1966 | Coleman | 2/174 |
| 3,319,262 | A | * | 5/1967 | Lee | 2/174 |
| 3,529,308 | A | * | 9/1970 | McBride | 2/174 |
| 3,996,946 | A | * | 12/1976 | Craig | 2/174 |
| 4,964,175 | A | * | 10/1990 | Taylor | 2/174 |
| 5,524,650 | A | * | 6/1996 | Ponce | 132/212 |
| 5,628,070 | A | * | 5/1997 | Kefelian | 2/174 |
| 5,675,840 | A | * | 10/1997 | Clavelle | 2/174 |
| 5,940,885 | A | * | 8/1999 | Matthews | 2/174 |

FOREIGN PATENT DOCUMENTS

| | | | | |
|---|---|---|---|---|
| DE | 4400924 A1 | | 9/1994 | |
| DE | 4400924 | * | 9/1994 | 132/212 |

* cited by examiner

*Primary Examiner*—Eduardo C. Robert
(74) *Attorney, Agent, or Firm*—Michael A Mann; Nexsen Pruet Jacobs & Pollard LLC

(57) ABSTRACT

A system of components that cooperate to shield the exposed skin of the ears, forehead and neck against contact by a hot curling iron includes a head band, an ear piece, and neck shield. The ear pieces fit over the ears, cupping the tops and backs of the ears to both protect them and derive support for the system from them. The head band and neck shield attach to ear pieces and are made of a heat resistant fabric. The three components will not prevent burns in every case but can prevent or limit injury from the proximity of the hot curling iron and harm from the occasional, inadvertent touching of the iron.

3 Claims, 2 Drawing Sheets

CURLING IRON SHIELD

PRIORITY CLAIM

This application is a continuation in part of U.S. application Ser. No. 09/717,462 filed Nov. 20, 2000, now abandoned, which is a continuation in part of U.S. application Ser. No. 09/498,730 dated Apr. 14, 2000, abandoned.

FIELD OF THE INVENTION

The present invention relates generally to hair care and, in particular, to devices used in connection with curling irons and other heat producing products used in hair care such as straightening combs and heated rollers.

BACKGROUND OF THE INVENTION

Using a curling iron can be dangerous work as one navigates around exposed ears, neck and forehead. The iron is hot and the skin of the forehead, ears, and neck is sensitive. Furthermore, even when using a mirror, it is possible to have the hot curling iron come into contact with the skin or come close enough so that the heat from the iron hurts.

There is therefore a need for a way to prevent injury to the skin of the forehead, neck, and ears from heat-producing hair care products such as curling irons, straightening combs and heated rollers.

SUMMARY OF THE INVENTION

According to its major aspects and briefly described, the present invention is a system of components that cooperate with each other to shield the exposed skin of the ears, forehead and neck against contact by heated hair care device during use. The three components include a head band, two ear pieces and a neck shield. The head band and neck shield attach to the ear pieces which cover the ears, each cupping the pinna of the ear. The three components will not prevent burns in every case but can prevent or limit injury from the proximity of the hot curling iron and the occasional, inadvertent touching of the iron to the skin.

A feature of the present invention is the ear piece. This component covers the pinna of ears, including the back of the pinna, which is the surface between the pinna and the scalp, protecting them from bums. This component, furthermore, is made of a heat-resistant polymer that holds its shape and thereby permits itself to be supported on the ears and to provide support in turn for the other two components. It uses the shape of the ears to provide support for the present device while at the same time providing protection for the ears which, because of their shape and disposition with respect to the head, are somewhat more vulnerable to injury when using a curling iron, for example.

Another feature of the present invention is the head band, which is stretched over the forehead to the ear shield to which it is attached using either hook and loop type fasteners or a mechanical clip. The headband uses the ear shield for support and helps to hold the ear shield on the ears.

Still another feature of the invention is the neck shield that protects the neck from the hairline down. The neck shield also derives support from the ear piece and helps to hold it in place.

These and other features and their advantages will be apparent to those skilled in the art of hair care devices from a careful reading of the Detailed Description of a Preferred Embodiment accompanied by the following drawings.

BRIEF DESCRIPTION OF THE DRAWINGS

In the Figures.

DETAILED DESCRIPTION OF A PREFERRED EMBODIMENT

Figure 1:
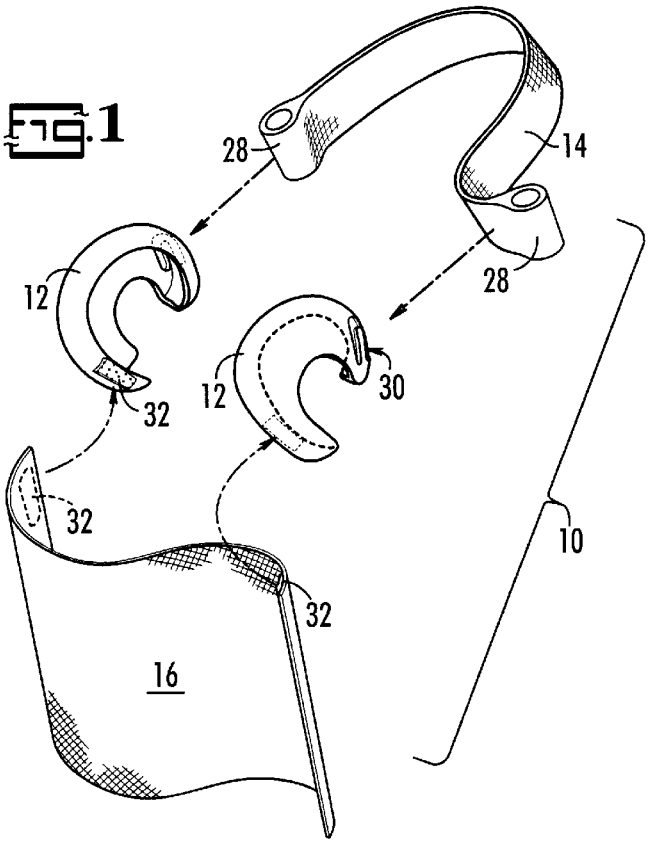
FIG. 1 is a perspective, exploded view of the components of the curling iron shield system according to a preferred embodiment of the present invention.
Figure 2:
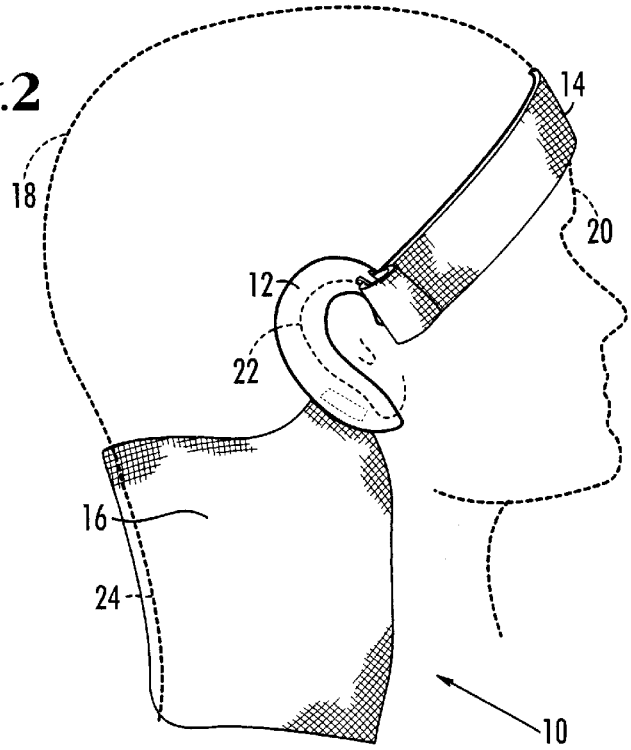
FIG. 2 is a perspective view of a curling iron shield system according to a preferred embodiment of the present invention, with a human user shown in phantom lines.
Figure 3A:
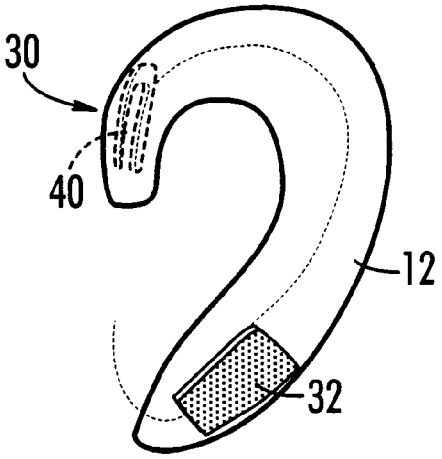
FIGS. 3A, 3B, 3C, and 3D are back, front, rear and top views, respectively, of a right ear piece, according to a preferred embodiment of the present invention.
Figure 3B:
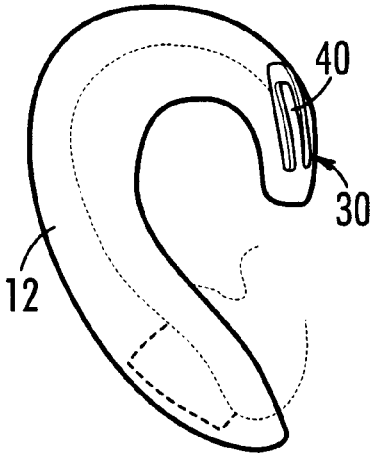
Figure 3C:
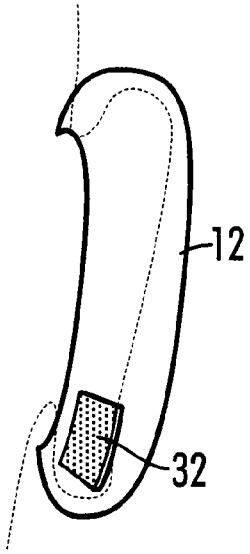
Figure 3D:
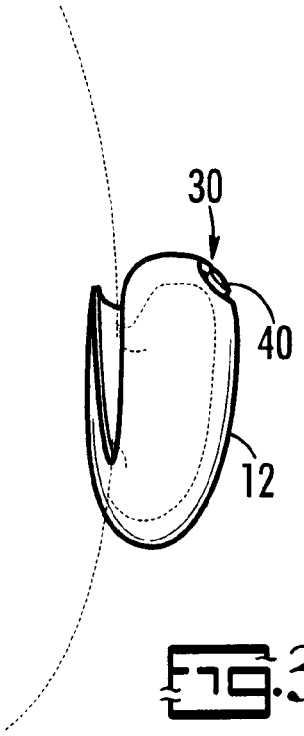

Referring now to the figures, FIGS. 1 and 2 illustrate the present shield system, according to a preferred embodiment of the invention. The system, generally indicated by reference number 10, includes three components: a pair of ear pieces 12, a head band 14 and a neck shield 16. The left side of the head shows a symmetric view of system 10. These three components cooperate together to provide protection of the head of the user 18 from the heat of a curling iron or other heated hair care product, be that heat from conduction through the air when the iron is proximate to the skin or from direct contact with the heated iron. More specifically, the shield system protects the forehead 20, the ears 22 and the neck 24.

Ear piece 12 covers ear 22 (the left side of the head also having an ear piece 12 symmetric to ear piece 12 on right side of the head). Ear piece 12 is preferably made of a material that is relatively rigid and that does not conduct heat very well, most preferably a thermally insulating material. There are a number of plastics that meet these requirements including most polymers such as vinyl.

Ear piece 12 curves around and over the pinna of ear 22 along the top, front, back, and end down to and including a substantial portion of the ear lobe, best seen in FIGS. 3A–3D, cupping this portion of ear 22 so that, when ear piece 12 is in place, it completely protects the pinna and rests on ear 22. By cupping the upper half of ear 22, ear piece 12 and system 10 derive their support from ears 22 and also provide protection for ears 22, which are especially vulnerable to injury because of the fact that ears 22 extend from the sides of the head at the hair line. The term "cupping" is a metaphor used herein to describe the shape of ear piece 12 where it covers ears 22. Cupping in this context refers then to a dual curvature: curving around the profile of the pinna when the pinna is viewed from the side, the end, and the top, wrapping around the profile of the pinna.

Headband 14, is simply a long rectangle of a material that is slightly elastic so that it can stretch from one side of ear piece 12 to the other. It is attached to ear piece 12 in some convenient way, preferably just below the hair line. The mode of attachment is preferably a mechanical clip 30 on ear piece 12, but may also be hook and loop type fasteners such as those sold under the trademark VELCRO®. The point of attachment is preferably the top of ear pieces 12. As shown in FIG. 1, a loop 28 is formed in each end of headband 14 to allow it to be slipped onto clip 30, which is a small opening with an upstanding projection 40 that fits into loop 28.

The material from which head band 14 is made can be any fabric that stretches and is not a heat conductor but preferably heat resistant. Cotton and cotton blends, preferably knitted or elasticized, can meet these requirements easily.

Material such as that sold under the trademark NOMEX by Southern Mills, Inc., is suitable for use.

Neck shield 16, when in position, runs from the back of the lower portion of ear piece 12 of one ear 22 to the equivalent location on the other ear piece 12 on the opposing ear 22, covering the back of neck 24 at the hairline downward. Neck shield 16 is preferably made of a flexible material that does not conduct heat such as cotton or cotton blend. A suitable fabric for neck shield 16 is sold under the trademark NOMEX made by Southern Mills, Inc. The preferred form of attachment is hook and loop fasteners 32 on both the corners of neck shield 16 and the ear covering portions of ear pieces 12, most preferably on the back of ear pieces 12, which means the portion of ear pieces 12 that faces the scalp, rather than the front of ear pieces 12, which is the portion facing away from the user's head.

In use, the user lifts her hair and slides ear pieces 12 into place on ears 22. Then neck shield 16 can be attached to ear pieces 12 using hook and loop fasteners 32. Neck shield 16 is placed around the back of neck 24. The user then applies head band 14 across forehead 20 from one ear piece 12 to the other, attaching the ends of head band 13 to ear pieces 12 using clips 30.

Many modifications and substitutions can be made to the foregoing preferred embodiment without departing from the spirit and the scope of the present invention, as defined by the appended claims.

What is claimed is:

1. A shield system to be worn on the head of a user as protection when said user's hair is to be curled, said head having a hairline, ears, a forehead, and a neck, each ear having a pinna, said shield system comprising:

ear pieces curved to extend from the front to back of the pinnae of the ears of the user, wherein when said ear pieces are worn said ear pieces cover the front and back of said pinnae to protect said ears along a hairline of a head of a user and are supported by said pinnae;

a headband attachable to and supported by a clip carried by said ear pieces; and a neck shield attachable to a back of said ear pieces.

2. The shield system as recited in claim 1, wherein said ear pieces are made of a rigid polymer.

3. The shield system as recited in claim 1, wherein said headband is made of a heat-resistant, elasticized material.

* * * * *

UNITED STATES PATENT AND TRADEMARK OFFICE

CERTIFICATE OF CORRECTION

PATENT NO. : 6,505,633 B2
DATED : January 14, 2003
INVENTOR(S) : Mosely, Myra J.

It is certified that error appears in the above-identified patent and that said Letters Patent is hereby corrected as shown below:

Column 1,
Line 45, delete “bums” and insert -- burns. --

Signed and Sealed this

Twentieth Day of May, 2003

JAMES E. ROGAN
*Director of the United States Patent and Trademark Office*